United States Patent [19]

Fujikawa

[11] Patent Number: 4,533,908

[45] Date of Patent: Aug. 6, 1985

[54] WARNING MEANS FOR A SAFETY VALVE OF A HYDRAULIC POWER UNIT AND A HYDRAULIC POWER UNIT HAVING THE SAME

[75] Inventor: Masaki Fujikawa, Fujinomiya, Japan

[73] Assignee: Yasui Sangyo Co., Ltd., Fujinomiya, Japan

[21] Appl. No.: 329,021

[22] Filed: Dec. 9, 1981

[51] Int. Cl.[3] ..... G08B 21/00

[52] U.S. Cl. ..... 340/626; 137/557; 251/129.04; 340/611

[58] Field of Search ..... 340/611, 626; 251/131; 137/557

[56] References Cited

U.S. PATENT DOCUMENTS 3,551,620 12/1970 Hoover ..... 340/611 X
4,166,936 9/1979 Tice ..... 340/611 X
4,181,835 1/1980 Stadler et al. ..... 340/611 X
4,366,837 1/1983 Roettgen ..... 340/626 X
4,417,236 11/1983 Hung ..... 340/626

*Primary Examiner*—David L. Trafton
*Attorney, Agent, or Firm*—Poms, Smith, Lande & Rose

[57] ABSTRACT

A warning means for a safety valve of a hydraulic power unit and a hydraulic power unit having the same for use in a lifting jack, a vehicle lift, or the like, are disclosed. When an overload is given to a cylinder chamber of a hydraulic power unit, a safety valve is automatically opened so as to release an oil in the overloaded cylinder chamber back to an oil tank. When the safety valve is opened, a warning means switches on a caution buzzer and a caution lamp to appeal the overload to the senses of eyesight and hearing of a human being in order to prevent an accident to be followed previously. The warning means comprises a reed switch and a magnet adapted to be moved by the oil passed through the safety valve.

2 Claims, 4 Drawing Figures

WARNING MEANS FOR A SAFETY VALVE OF A HYDRAULIC POWER UNIT AND A HYDRAULIC POWER UNIT HAVING THE SAME

BACKGROUND OF THE INVENTION

The present invention relates to a warning means for a safety valve of a hydraulic power unit and a hydraulic power unit including the same, for use in a hydraulic lifting jack, a hydraulic vehicle lift, or the like.

In a conventional hydraulic lifting jack or vehicle lift, when an overload is given to a hydraulic power unit, a safety valve is opened automatically so as to release an oil in a cylinder chamber overloaded back to an oil tank.

SUMMARY OF THE INVENTION

It is an object of the present invention to provide a warning means for a safety valve of a hydraulic power unit, which detects and warns of an overload and call it to the senses of eyesight and hearing of a human being in order to prevent an accident.

It is another object of the present invention to provide a hydraulic power unit having a safety valve warning means which detects and warns of an overload and calls it to the senses of eyesight and hearing of a human being in order to prevent an accident.

According to the present invention there is provided a warning means for a safety valve of a hydraulic power unit, comprising a valve body made of a nonmagnetic material, having a cylinder in which a magnet is movable, and a reed switch connected to a caution buzzer and a caution lamp, wherein the magnet is positioned normally away from the reed switch and is moved in front of the reed switch by an oil passed through the safety valve when the safety valve is opened by an overload, thereby switching on the reed switch.

According to the present invention there is also provided a hydraulic power unit wherein, when an overload is given to a cylinder chamber, a safety valve is opened so as to release an oil in the cylinder chamber overloaded back to an oil tank, the improvement which comprises a warning means which switches on a caution buzzer and a caution lamp when the safety valve is opened.

BRIEF DESCRIPTION OF DRAWINGS

Other objects and features of the present invention will be clear from the description of preferred embodiments of the present invention in connection with the accompanying drawings, in which.

DESCRIPTION OF THE PREFERRED EMBODIMENTS

Figure 1:
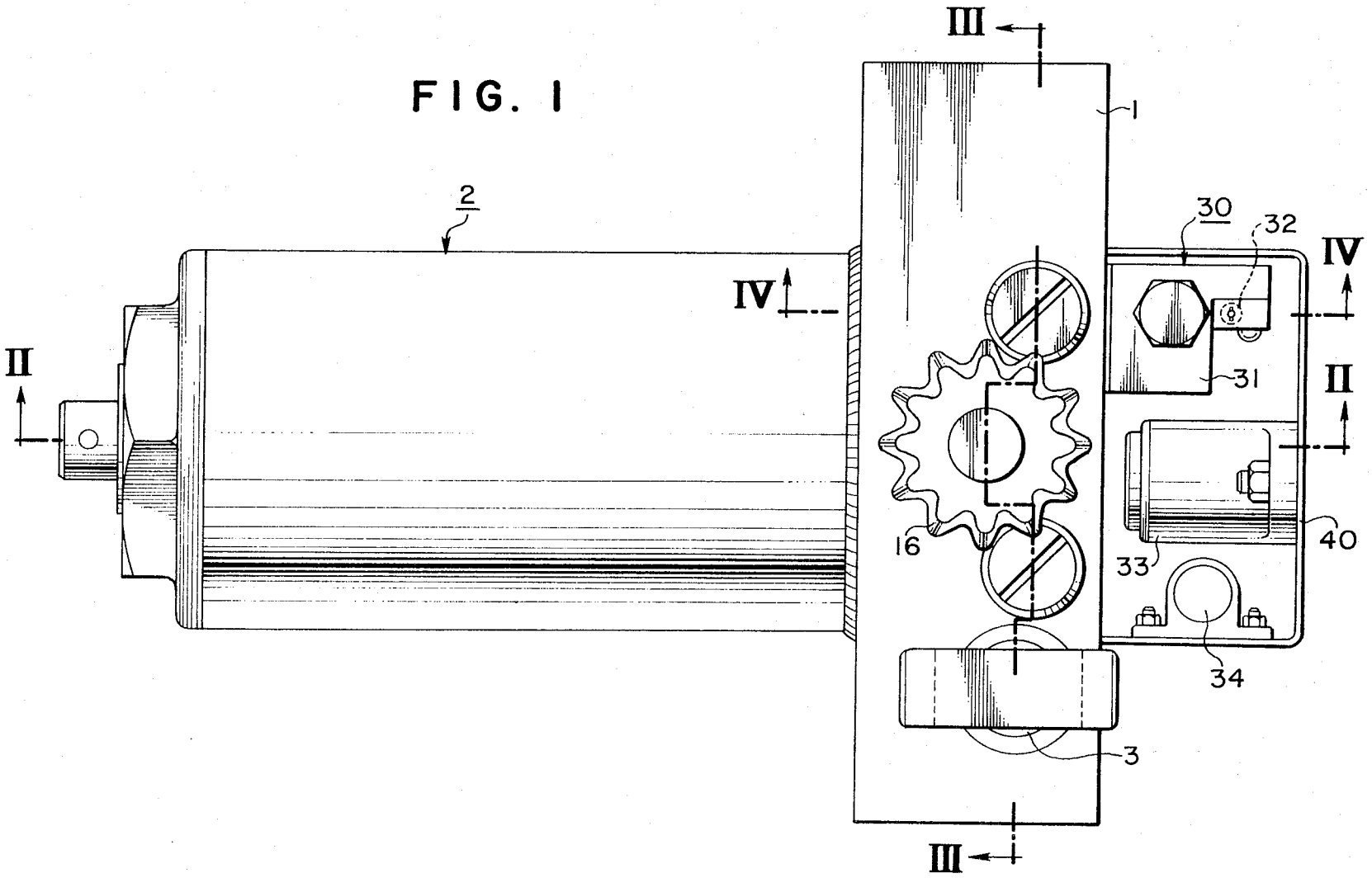
FIG. 1 is a top plan view of a hydraulic power unit having a warning means for a safety valve according to the present invention.
Figure 2:
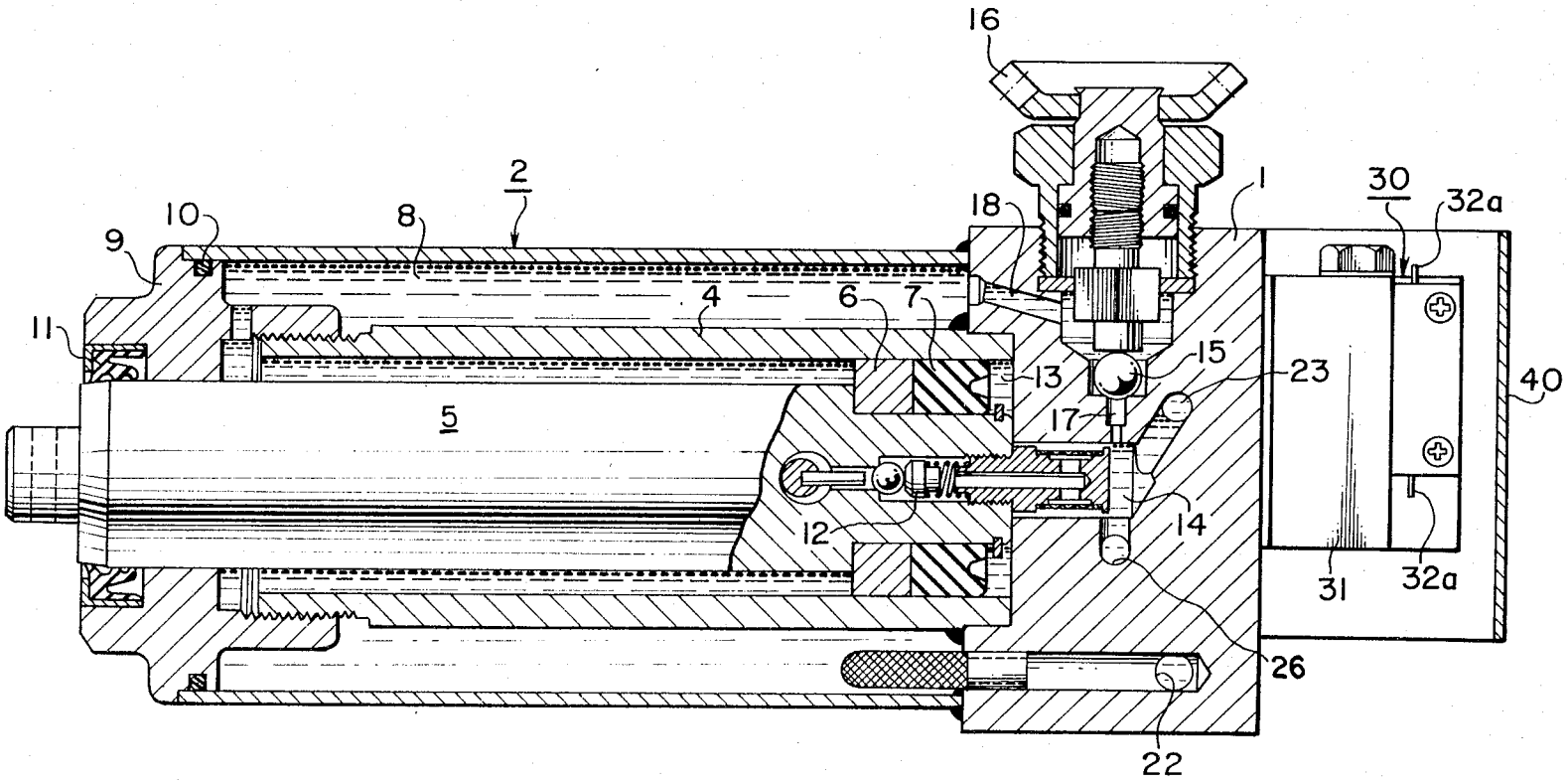
FIG. 2 is a longitudinal central cross-section, taken along the line II—II in FIG. 1.
Figure 3:
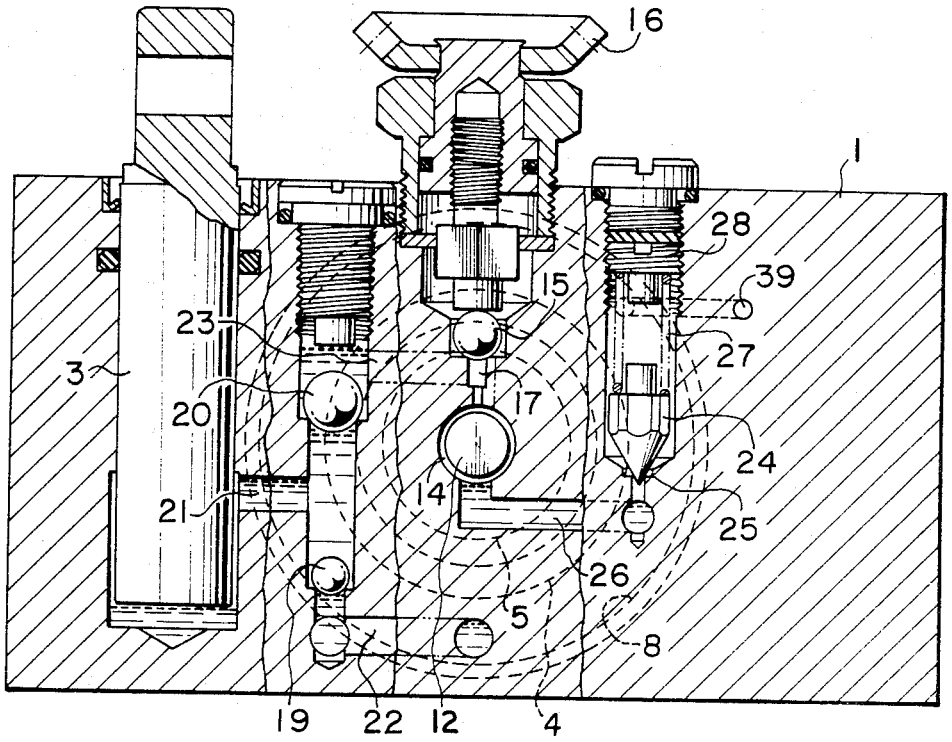
FIG. 3 is a longitudinal cross-section, taken along the line III—III in FIG. 1.
Figure 4:
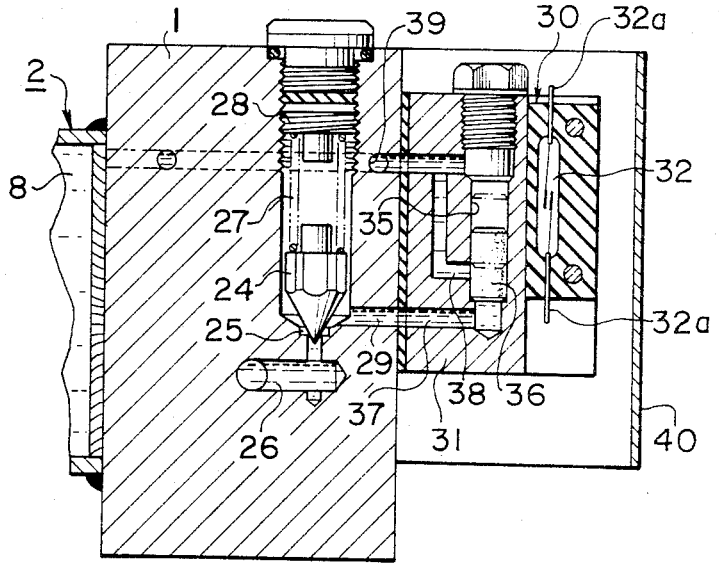
FIG. 4 is a longitudinal cross-section, taken along the line IV—IV in FIG. 1.

Referring now to the drawings there is shown in FIGS. 1–4 a hydraulic power unit having a warning means for a safety valve, for use in a hydraulic lifting jack, a hydraulic vehicle lift, or the like, according to the present invention.

The hydraulic power unit comprises an oil box 1, a cylinder means 2 connected to the front end of the oil box 1, and a plunger 3 which is mounted to one side of the oil box 1 and actuates the cylinder means 2.

The cylinder means 2 comprises a cylinder 4, a ram 5 reciprocally moved therein together with a guide 6 which is secured to the base part of the ram 5 and is slidable on the inner surface of the cylinder 4, a packing 7 made of a polyurethane resin, or the like, which seals between the cylinder 4 and the ram 5, an oil tank 8 surrounding the cylinder 4, and a tank nut 9 which closes tightly the end of the oil tank 8 via an O-ring 10 for preventing the oil from the leakage. The ram 5 projects from the central hole of the tank nut 9. The oil leakage between the ram 5 and the tank nut 9 is prevented by an oil-seal 11.

The ram 5 is provided with a stroke end relief valve 12 of a conventional type in its central base end, which releases the pressure of a cylinder chamber 13 when the ram 5 advances to its front stroke end. The stroke end relief valve 12 projects rearwards in an oil chamber 14 which is formed in the oil box 1 and is connected to the cylinder chamber 13.

The oil box 1 is provided with a relief valve 15 of a conventional type in its central portion, which is opened by turning a relief valve gear 16 and which leads to the oil chamber 14 via a path 17 and the oil tank 8 via a relief path 18.

The oil box 1 is also provided with a inhalation valve 19 and an exhaust valve 20 near the plunger 3. The outlet of the inhalation valve 19 and the inlet of the exhaust valve 20 are connected to the plunger 3 via a common path 21. The inlet of the inhalation valve 19 is connected to the oil tank 8 via a inlet path 22, and the outlet of the exhaust valve 20 is connected to the oil chamber 14 via an outlet path 23.

Therefore, the ram 5 is advanced by sending the oil from the oil tank 8 to the cylinder chamber 13 via the inhalation valve 19, the exhaust valve 20, and the oil chamber 14 by reciprocating the plunger 3. Meanwhile, the ram is retracted by opening the relief valve 15 by turning the relief valve gear 16.

The oil box 1 is further provided with a safety valve 24 in the opposite side to the plunger 3, and a valve seat 25 of the safety valve 24 is connected to the cylinder chamber 13 through the oil chamber 14 and a safety path 26. Hence, the same pressure as that in the cylinder chamber 13 is given to the safety valve 24. A relief pressure is given to the safety valve 24 by a coil spring 27 which is positioned between the safety valve 24 and an adjusting stop screw 28, and biases the safety valve 24 to the valve seat 25. The set pressure of the safety valve 24 is adjusted by turning the adjusting stop screw 28 in advance. A relief path 29 is formed above the valve seat 25.

A warning means 30 for the safety valve 24 is attached to the rear end of the oil box 1, and comprises a valve body 31 made of a nonmagnetic material, a reed switch 32 vertically attached thereto, a caution buzzer 33, and a caution lamp 34, the latter two being connected electrically to leads 32*a* of the reed switch 32 via an electric source (not shown) such as a dry cell.

The valve body 31 is provided with a vertical cylinder 35 in parallel with the reed switch 32, in which a cylindrical magnet 36 is inserted and is movable up and down. The bottom of the vertical cylinder 35 is connected to the relief path 29 via a path 37, and is provided with a side path 38 in its lower portion. The side path 38 is normally closed by the cylindrical magnet 36 positioned in the bottom of the vertical cylinder 35, and is opened when the cylindrical magnet is moved up. The side path 38 leads to the oil tank 8 via a relief path 39. The warning means 30 described above is covered by a cover 40.

When the overload is given to the cylinder chamber 13, the safety valve 24 is pushed up and opened, and the oil in the cylinder chamber 13 overloaded is flowed back to the oil tank 8 through the oil chamber 14, safety path 26, the valve seat 25, the relief path 29, vertical cylinder 35, the side path 38, and the relief path 39, while the cylindrical magnet 36 is pushed up in the vertical cylinder 35. When the magnet 36 pushed is moved in front of the reed switch 32, the reed switch 32 is switched on, with the result that the caution buzzer 33 and the caution lamp are switched on.

It is readily understood from the above description, of course, the warning means described above can be utilized for a safety valve which is actuated by a fluid such as the air, the water, the steam, a gas, and a liquid.

Although the present invention has been described in some detail by way of illustration and example for purposes of clarity of understanding, it will, of course, be understood that various changes and modifications may be made in the form, details, and arrangements of the parts without departing from the scope of the present invention as set forth in the following claims.

What is claimed is:

1. A warning means for a safety valve of a hydraulic power unit, wherein said power unit is provided with a chamber having a safety valve in communication with a fluid relief path in further communication with an oil tank, said warning means comprising:

a valve body made of a nonmagnetic material and provided with a fluid conducting cylinder in communication with said relief path:

a magnet moveably positioned within said cylinder; and a magnetically operated electric reed switch disposed adjacent to said cylinder and connected to a caution buzzer and a caution lamp, wherein the magnet is normally positioned away from the magnetically operated electric reed switch and is directly moved to a position adjacent the magnetically operated electric reed switch by an oil passed from said chamber through the safety valve and relief path and into said cylinder when the safety valve is opened by an overload in said chamber, thereby switching on the magnetically operated electric reed switch and operating the caution buzzer and caution light.

2. In an hydraulic power unit provided with a chamber having an overload safety valve in communication with a fluid relief path in further communication with an oil tank, the improvement comprising:

overload safety valve warning means formed of a valve body made of a nonmagnetic material and provided with a fluid conducting cylinder in communication with said relief path between said safety valve and said oil tank;

a magnet moveably positioned within said cylinder; and a magnetically operated electric reed switch disposed adjacent to said cylinder and connected to a caution buzzer and a caution lamp, wherein the magnet is normally positioned away from the magnetically operated electric reed switch and is directly moved to a position adjacent the magnetically operated electric reed switch by an oil passed from said chamber through the safety valve and relief path and into said cylinder when the safety valve is opened by an overload in said chamber, thereby switching on the magnetically operated electric reed switch and operating the caution buzzer and caution light.

* * * * *